US011731860B2

(12) United States Patent
Wang et al.

(10) Patent No.: US 11,731,860 B2
(45) **Date of Patent: *Aug. 22, 2023**

(54) LIFTING VEHICLE FRAME, AERIAL TRANSPORTATION VEHICLE AND AERIAL RAIL CONTAINER TRANSPORTATION METHOD

(71) Applicant: CRRC YANGTZE CO., LTD., Wuhan (CN)

(72) Inventors: Quanhu Wang, Wuhan (CN); Lijie Su, Wuhan (CN); Aiwen Liu, Wuhan (CN); Wei Liu, Wuhan (CN); Zhiguo Chen, Wuhan (CN); Jianyun Hou, Wuhan (CN); Zixun Wang, Wuhan (CN); Hui Luo, Wuhan (CN); Xiong Yao, Wuhan (CN); Heng Huang, Wuhan (CN); Shaobo Song, Wuhan (CN); Xiaole Ke, Wuhan (CN); Ye Feng, Wuhan (CN)

(73) Assignee: CRRC YANGTZE CO., LTD., Wuhan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/594,863

(22) PCT Filed: Jul. 28, 2020

(86) PCT No.: PCT/CN2020/105226

§ 371 (c)(1),
(2) Date: Nov. 1, 2021

(87) PCT Pub. No.: WO2021/135195

PCT Pub. Date: Jul. 8, 2021

(65) Prior Publication Data

US 2022/0212901 A1 Jul. 7, 2022

(30) Foreign Application Priority Data

Dec. 31, 2019 (CN) ..... 201911417527.3

(51) Int. Cl.
*B66C 11/00* (2006.01)
*B66C 11/04* (2006.01)
(Continued)

(52) U.S. Cl.
CPC ..... *B66C 11/04* (2013.01); *B66C 1/101* (2013.01); *B66C 9/02* (2013.01); *B66C 19/00* (2013.01)

(58) Field of Classification Search
CPC ..... B66C 1/101; B66C 1/223; B66C 1/663; B66C 19/00; B66C 9/02; B66C 9/10;
(Continued)

(56) References Cited

FOREIGN PATENT DOCUMENTS

CN 110341657 A * 10/2019
CN 110498224 A * 11/2019 ..... B23K 37/00
(Continued)

OTHER PUBLICATIONS

First Office Action by the CNIPA of the counterpart Chinese application No. 201911417527.3 dated Sep. 3, 2020.

*Primary Examiner* — Emmanuel M Marcelo
(74) *Attorney, Agent, or Firm* — Platinum Intellectual Property PC

(57) ABSTRACT

The disclosure relates to a lifting vehicle frame and an aerial transportation vehicle. The aerial transportation vehicle includes a lifting vehicle frame, which includes an upper vehicle frame (1), a lower vehicle frame (2), a lifting assembly (a) and a locking device (b), wherein the upper vehicle frame (1) and the lower vehicle frame (2) are connected through the lifting assembly (a); at least two lifting assemblies (a) are provided opposite to each other in a first direction; the lower vehicle frame (2) and the upper vehicle frame (1) can move close to or apart from each other by operating the at least two lifting assemblies (a); the locking device (b) is disposed on the lower vehicle frame
(Continued)

(2); when the lower vehicle frame (2) and the upper vehicle frame (1) move close to each other, the lower vehicle frame (2) and the upper vehicle frame (1) are locked together by operating the locking device (b). The aerial transportation vehicle of the disclosure can achieve connection and assembly with a container by its own devices, which is simple in operation, and has high automatic level and good practicability.

10 Claims, 3 Drawing Sheets

(51) Int. Cl.
*B66C 9/02* (2006.01)
*B66C 19/00* (2006.01)
*B66C 1/10* (2006.01)

(58) Field of Classification Search
CPC .. B66C 11/04; B61B 3/02; B61D 3/20; B61D 45/007; B61D 47/00; B66D 1/12
See application file for complete search history.

(56) References Cited

FOREIGN PATENT DOCUMENTS

| | | | |
|---|---|---|---|
| EP | 1106563 | A2 | 6/2001 |
| JP | H04121394 | A | 4/1992 |

* cited by examiner

LIFTING VEHICLE FRAME, AERIAL TRANSPORTATION VEHICLE AND AERIAL RAIL CONTAINER TRANSPORTATION METHOD

CROSS-REFERENCE OF RELATED ART

The present application claims the priority of Chinese patent application No. 201911417527.3, filed on Dec. 31, 2019 and entitled "lifting vehicle frame and aerial transportation vehicle", which is incorporated herein by reference in its entirety.

TECHNICAL FIELD

The disclosure relates to the field of logistics and transportation, and in particular, to a lifting vehicle frame, an aerial transportation vehicle, and an aerial rail container transportation method.

BACKGROUND OF THE INVENTION

At present, China's port collection and distribution system mainly relies on road transportation (up to 84%). However, the road transportation involves high pollution to environment, high transportation cost, and especially the connection for the last kilometer to the container port has become a primary problem in the development of comprehensive transportation system in China.

In order to solve the above technical problems, aerial rail transportation equipment applied to port container logistics has appeared. The aerial rail transportation line may span road, river, factory, etc. to solve the problem of the last kilometer transportation of containers.

In the process of implementing the disclosure, the applicant found that there are at least the following shortages in the existing aerial rail transportation of containers.

In the prior art, the container is firstly lifted through a ground jacking device to connect and assemble to a vehicle body of an aerial transportation vehicle, which requires an external jacking device to achieve the connection and assembly of the container and the vehicle body. In operation, a jacking device needs to be moved to a fixed position for connection to the vehicle body. Then the container is hoisted to the jacking device, and then the jacking device is operated to connect and assemble the container to the vehicle body. After the connection and assembly of all the containers to the vehicle body are completed, it is necessary to remove the jacking device. The operating process is very cumbersome.

Therefore, there is a need to improve the prior art to provide a lifting vehicle frame and an aerial transportation vehicle as well as an aerial rail container transportation method so as to solve the problem in the prior art that the operating process for assembling and connecting a container and the vehicle body of an aerial transportation vehicle is cumbersome.

SUMMARY OF THE INVENTION

To address the problems in the prior art, the disclosure provides a lifting vehicle frame, an aerial transportation vehicle and an aerial rail container transportation method to solve the problem in the prior art that the operating process for assembling and connecting a container and the vehicle body of an aerial transportation vehicle is cumbersome.

In one aspect of the disclosure, a lifting vehicle frame is provided, which may include: an upper vehicle frame; a lower vehicle frame; and a lifting assembly. The upper vehicle frame and the lower vehicle frame may be connected through the lifting assembly. At least two lifting assemblies may be provided in a first direction. The lower vehicle frame and the upper vehicle frame may be moved close to or away from each other by operating the at least two lifting assemblies, and each lifting assembly may include a lifting motor, a wire rope, and a movable pulley, wherein two lifting motors may be provided opposite to each other in a second direction, and the two lifting motors may be fixed to the upper vehicle frame. The second direction and the first direction may be perpendicular. The movable pulley and the lifting motor may be provided correspondingly in one-to-one relation, and the two movable pulleys may be rotatably disposed on the lower vehicle frame in the second direction. The wire rope, the lifting motor and the movable pulley may be provided correspondingly in one-to-one relation, and the wire rope may have a first end and a second end opposite to each other. The first end and the second end of the wire rope may both be wound around an output end of a corresponding lifting motor, and the movable pulley may be disposed in the middle of a corresponding wire rope. The lifting vehicle frame also includes a locking device disposed on the lower vehicle frame. The lower vehicle frame and the upper vehicle frame can be locked together by operating the locking device when the lower vehicle frame and the upper vehicle frame are close to each other.

In some embodiments of the disclosure, each lifting assembly may be provided with a tension sensor.

In some embodiments of the disclosure, an output shaft of each lifting motor may be fixedly provided with a reel, and the first end and the second end of the wire rope may be wound on the reel of a corresponding lifting motor.

Further, in some embodiments of the disclosure, a brake member may also be provided on the lifting motor. The brake member and the reel may be provided correspondingly in one-to-one relation, and an output end of the brake member may operably act on the reel.

In some embodiments of the disclosure, the locking device may include: a rotary pin; a locking head, the locking head is able to be fixedly provided at the head of the rotary pin; a rotary handle fixedly disposed at the bottom of the rotary pin, the rotary handle may be formed with a first limit face and a second limit face on its periphery; a lifting pin, a central axis of the lifting pin and a central axis of the rotary pin may be parallel with each other, the lifting pin operably moves up and down along the central axis of the lifting pin, and the lifting pin may be provided with a support protrusion; a limit block, the limit block may be fixedly provided at the bottom of the lifting pin, and the limit block may be operably engaged with the first limit face or the second limit face; a reset spring, the reset spring may be fitted on the lifting pin, and the reset spring may be disposed between the support protrusion and the limit block; a driving mechanism, an output end of the driving mechanism can be connected to the rotary handle, and the rotary handle can be rotated by operating the driving mechanism. The upper vehicle frame may be formed with a lock hole corresponding to the locking device at its bottom, and the locking head of the locking device is rotatable within a corresponding lock hole. The top and bottom of the lower vehicle frame may both be formed with a first through hole corresponding to the rotary pin of the locking device, and the rotary pin may fixedly pass through corresponding first through holes at the top and bottom of the lower vehicle frame, and the rotary handle may be located below the bottom of the lower vehicle frame. The top and bottom of the lower vehicle frame may both be formed with a second through hole corresponding to the lifting pin of the locking device, and the lifting pin may be extendable and retractable inside the second through holes at the top and bottom of the lower vehicle frame, and the reset spring may be disposed between the support projection and the partition.

In some embodiments of the disclosure, the rotary pin may also be provided with a locking seat and a carrying table. The locking seat and the carrying table may be sequentially disposed between the locking head and the rotary handle, and a first gap may be formed between the locking head and the locking seat. The top of the lower vehicle frame may be clamped in the first gap, and a second gap may be formed between the carrying table and the rotary handle. The bottom of the lower vehicle frame may be clamped in the second gap.

In some embodiments of the disclosure, the locking seat and the carrying table may fit with each other with spherical surfaces.

In some embodiments of the disclosure, the bottom of the upper vehicle frame may be formed with a third through hole fitted with the locking device, and the third through hole may be passed by a head portion of the lifting pin of a corresponding locking device.

In some embodiments of the disclosure, the locking device may further include a sleeve, and the sleeve may be fixedly provided below the bottom of the lower vehicle frame. The lifting pin may be extendable and retractable in the sleeve, and the limit block may be located below the sleeve.

In another aspect of the disclosure, an aerial transportation vehicle is provided, and the vehicle can include a lifting vehicle frame of the disclosure.

In yet another aspect of the disclosure, an aerial rail container transportation method is provided. The method is implemented by using the aerial transportation vehicle described in the disclosure. The aerial transportation vehicle may include a lifting vehicle frame. The lifting vehicle frame may include an upper vehicle frame; a lower vehicle frame; a lifting assembly; and a locking device. The lower vehicle frame and the upper vehicle frame can be moved close to or away from each other by operating the lifting assembly. The lower vehicle frame and the upper vehicle frame close to each other can be locked with each other by operating the locking device. The aerial rail container transportation method comprises: the aerial transportation vehicle being free of load and running into position and stopping, so that the container is located directly below the aerial transportation vehicle; operating the lifting assembly to separate the upper vehicle frame from the lower vehicle frame; operating the lifting assembly to lower the lower vehicle frame; opening a container anti-falling device on the lower vehicle frame; completing the locking of the lower vehicle frame and the container by operating the locking device therebetween; operating the lifting assembly, so that the lower vehicle frame and the container rise as a whole; the container anti-falling device on the lower vehicle frame being shrunk so that the container anti-falling device holds the container; operating the lifting assembly and the locking device so that the lower vehicle frame and the upper vehicle frame are locked with each other; the aerial transportation vehicle being started for transportation after the container assembly process is completed.

The beneficial effects of the disclosure include at least the following:

First, an aerial transportation vehicle provided by the disclosure includes a lifting vehicle frame, and an upper vehicle frame of the lifting vehicle frame can be hung on an aerial rail by a bogie, and a lower vehicle frame is used for assembly of the container. The lower vehicle frame and the upper vehicle frame can move close to or away from each other by operating at least two lifting assemblies. Firstly, the lower vehicle frame and the upper vehicle frame are operated to be separated from each other, at which time the container is hoisted to the lower vehicle frame. Then the lower vehicle frame and the upper vehicle frame are operated to be close to each other, and the locking device is operated to lock the lower vehicle frame and the upper vehicle frame together. Thereby the assembly and connection of the container with the aerial transportation vehicle for container can be achieved. If the container is to be unloaded, opposite operations may be conducted. Therefore, the problem in the prior art that the operating process for assembling and connecting a container and the vehicle body of an aerial transportation vehicle is cumbersome are solved.

Secondly, with the aerial transportation vehicle and the aerial rail container transportation method of the disclosure, the assembly and connection of the aerial transportation vehicle and the container can be done by the devices of the vehicle itself, which is simple in operation, and has a high degree of automation and good practicality.

BRIEF DESCRIPTION OF THE DRAWINGS

In order to more clearly illustrate the technical solutions in embodiments of the disclosure, the drawings to be used in the description of the embodiments will be briefly introduced below. It will be apparent that the drawings in the following description are merely some embodiments of the disclosure, and those of ordinary skill in the art may also obtain other drawings according to these drawings without creative labor.

DETAILED DESCRIPTION OF THE INVENTION

The technical solutions in the embodiments of the disclosure will be clearly and completely described in conjunction with the drawings in the embodiments of the disclosure. Obviously, the described embodiments are merely some of the embodiments of the disclosure, not all of the embodiments. Other embodiments obtained by one of ordinary skill in the art without inventive labor based on the embodiments in the disclosure are all within the scope of protection of the disclosure.

The aerial transportation vehicle provided by the disclosure can realize the assembly and connection of an aerial container transportation vehicle with a container, thereby solving the problem in the prior art that the operation of assembly and connection of a container with a vehicle body of an aerial container transportation vehicle is cumbersome.

In some embodiments of the disclosure, the lifting vehicle frame may include a vehicle frame, a bogie, and a coupler buffer device. There may be several vehicle frames in order, and each vehicle frame may be equipped with at least two bogies, and two adjacent vehicle frames may be connected by the coupler buffer device. The bogie may travel on an aerial rail, which in turn can drive multiple vehicle frames to travel on the aerial rail.

In some embodiments of the disclosure, the bogie may be a non-power bogie, which can reduce a weight of the vehicle without affecting the traveling of the vehicle frame in comparison with a bogie having a driving function.

Figure 1:
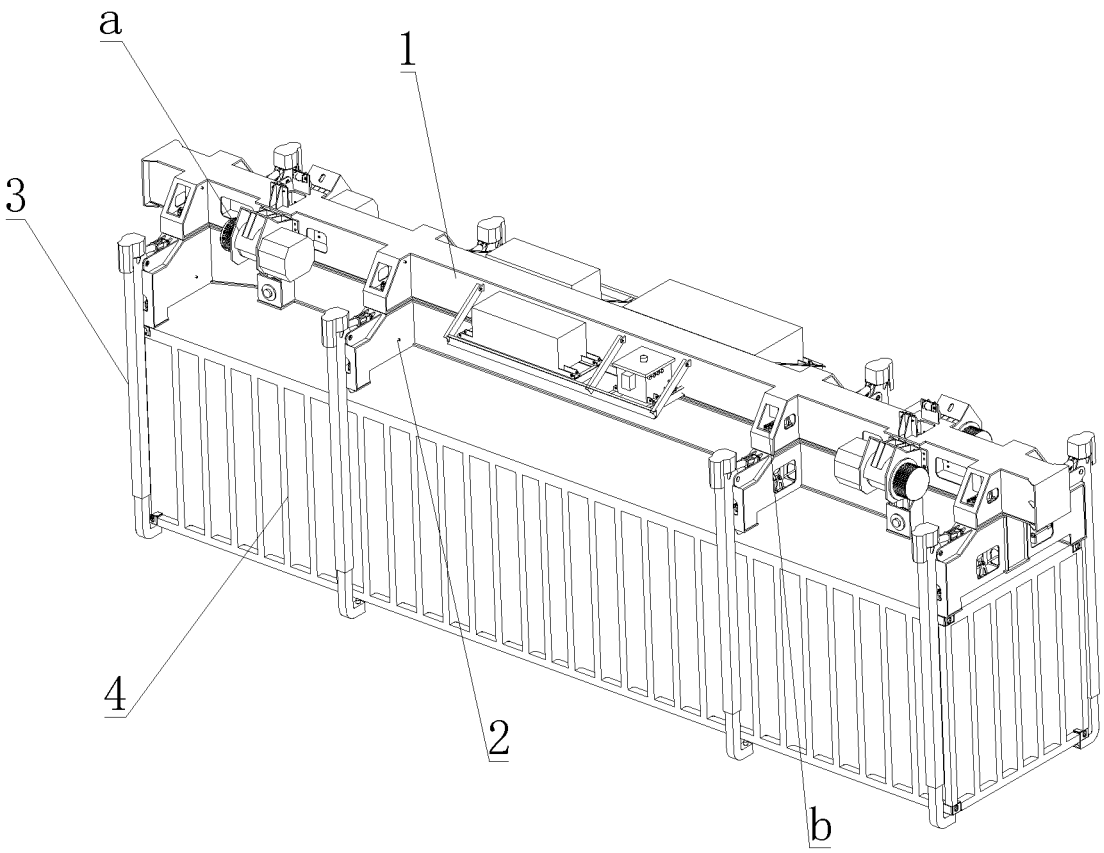
FIG. 1 is a schematic structural diagram of a lifting vehicle frame in an aerial transportation vehicle in accordance with an embodiment of the disclosure.

FIG. 1 is a schematic structural diagram of a lifting vehicle frame in an aerial transportation vehicle in accordance with an embodiment of the disclosure. As shown in FIG. 1, the lifting vehicle frame may primarily include an upper vehicle frame 1, a lower vehicle frame 2, a lifting assembly a, and a locking device b. When the vehicle frame is traveling on the aerial rail, the upper vehicle frame 1 and the lower vehicle frame 2 can be locked relative to each other. When the vehicle frame needs to be assembled with a container, the upper vehicle frame 3 and the lower vehicle frame 4 may be operated to be separated.

Figure 2:
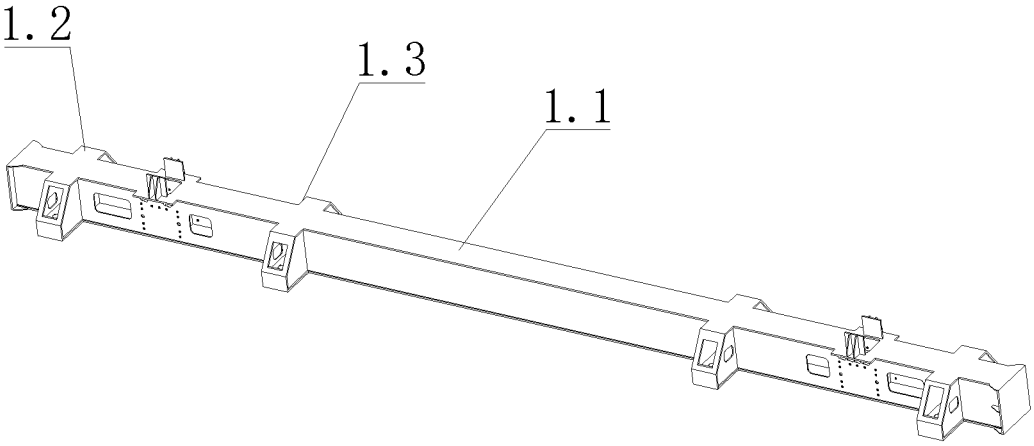
FIG. 2 is a schematic structural diagram of an upper vehicle frame in FIG. 1.

FIG. 2 is a schematic diagram showing the structure of the upper vehicle frame in FIG. 1. As shown in FIG. 2, in some embodiments of the disclosure, the upper vehicle frame 1 may be hung on the aerial rail by at least two bogies 1, and may include a first longitudinal beam 1.1, two first cross beams 1.2 and two second cross beams 1.3. The two first cross beams 1.2 may be disposed opposite to each other on the first longitudinal beam 1.1 along a length direction of a container. The two second cross beams 1.3 may be disposed opposite to each other on the first longitudinal beam 1.1 along the length direction of the container, and the two second cross beams 1.3 may be disposed between the two first cross beams 1.2.

Figure 3:
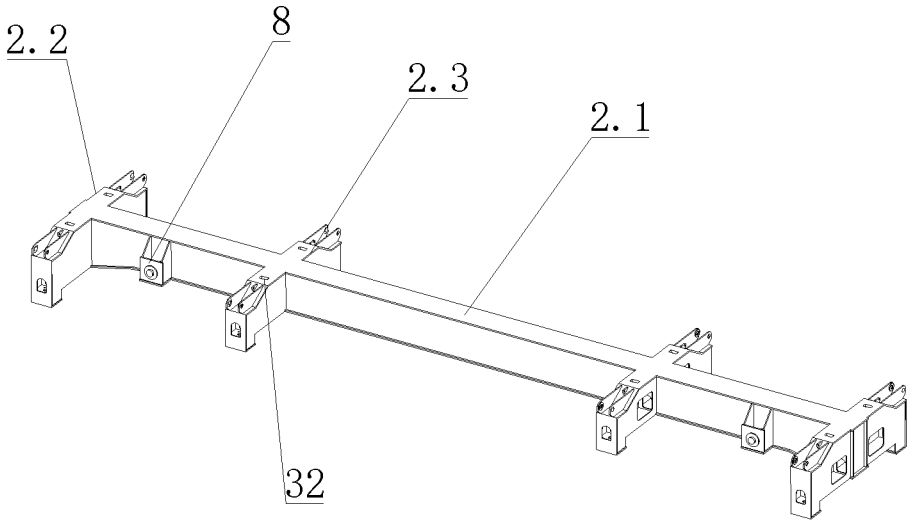
FIG. 3 is a schematic structural diagram of a lower vehicle frame in FIG. 1.

FIG. 3 is a schematic diagram of the structure of the lower vehicle frame of FIG. 1. As shown in FIG. 3, in some embodiments of the disclosure, the lower vehicle frame 2 may include a second longitudinal beam 2.1, two third cross beams 2.2, and two fourth cross beams. The second longitudinal beam 2.1 may be located directly below the first longitudinal beam 1.1, and the two third cross beams 2.2 may be disposed opposite to each other on the second longitudinal beam 2.1 along the longitudinal direction of the container. The two fourth cross beams 2.3 may be disposed opposite to each other on the second longitudinal beam 2.1 in the longitudinal direction of the container, and the two fourth cross beams 2.3 are located between the two third cross beams 2.2. The two third cross beams 2.2 may be located directly below the two first cross beams 1.1, respectively, and the two fourth cross beams 2.3 may be located directly below the two second cross beams 2.1, respectively.

As shown in FIG. 1, in some embodiments of the disclosure, the vehicle frame may also include a lifting assembly a. The upper vehicle frame 1 and the lower vehicle frame 2 are connected by the lifting assembly a, and at least two lifting assemblies are provided opposite to each other in a first direction. The lower vehicle frame 2 and the upper vehicle frame 1 can move close to or away from each other by operating the at least two lifting assemblies a.

In some embodiments of the disclosure, the first direction may be the length direction of the container.

Figure 4:
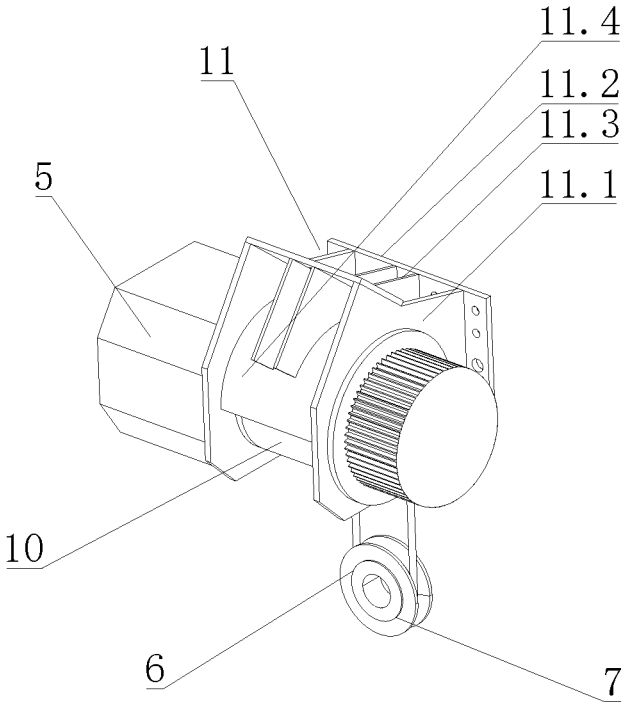
FIG. 4 is a schematic structural diagram of a lifting assembly in accordance with an embodiment of the disclosure.

FIG. 4 is a schematic structural diagram of the lifting assembly a in FIG. 1. In connection with FIGS. 1 and 4, in some embodiments of the disclosure, each lifting assembly may include a lifting motor 5, a wire rope 6, and a movable pulley 7. There may be two lifting motors 5 disposed opposite to each other in a second direction, and both lifting motors 5 may be fixed to the upper vehicle frame 1, and the second direction and the first direction may be perpendicular. The movable pulley 7 and the lifting motor 5 may be provided correspondingly in one-to-one relation, and the two movable pulleys 7 may be rotatably disposed on the lower vehicle frame 2 in the second direction. The wire rope 6 and the lifting motor 5 as well as the movable pulley 7 may be provided correspondingly in one-to-one relation, and the wire rope 6 can have a first end and a second end opposite to each other. The first end and the second end of the wire rope 6 may both be wound on an output end of a corresponding lifting motor 5, and the movable pulley 7 may be disposed in the middle of a corresponding wire rope 6.

In some embodiments of the disclosure, the second direction may be in a width direction of the container, and there may be two lifting assemblies a opposite to each other.

In some embodiments of the disclosure, the lower vehicle frame 2 and the upper vehicle frame 1 may be fixedly connected to or separated from each other by operating at least two lifting assemblies a, and thereby the assembly and connection of the vehicle body of the aerial rail container transportation equipment and a container is realized. The specific operations include:

The output end of the lifting motor 5 is controlled to rotate, so that the wire rope 6 of the same group is elongated, thereby the movable pulley 7 of the same group is lowered, and the lower vehicle frame 2 is lowered to a preset height. After the assembly of the container and the lower vehicle frame 2 is completed, the output end of the lifting motor 5 is controlled to rotate in a opposite direction, so that wire rope 6 of the same group rises, thereby the movable pulley 7 of the same group rises, and the lower vehicle frame 2 assembled with the container rises. After the locking of the upper vehicle frame 1 and the lower vehicle frame 2 is completed, the assembly and connection of the container with the vehicle frame are completed accordingly. For unloading the container, only contrary operations are needed.

In some embodiments of the disclosure, each lifting assembly may be provided with a tension sensor. The tension sensor can monitor an abnormal state, such as overloading, etc. to ensure the reliability of the assembly and connection of the container with the vehicle body.

In conjunction with FIGS. 1 and 4, in some embodiments of the disclosure, the output shaft of each lifting motor 5 may be fixedly provided with a reel 10, and the first end and second end of the wire rope 6 may be wound on the reel of a corresponding lifting motor. The lifting motor 5 can drive the rotation of the reel 10, and thus it is possible to realize the winding and unwinding of the wire rope 6 on the reel 10.

In some embodiments of the disclosure, the reel 10 can have a reduction box therein, which can reduce the speed of the reel 10, so that the lifting speed of the lower vehicle frame 2 can be reduced to improve the stability in lifting the lower vehicle frame 2.

In conjunction with FIGS. 1 and 4, in some embodiments of the disclosure, the upper vehicle frame 1 may be provided with a reel holder 11 corresponding to the reel 10 in one-to-one relation, and the reel 10 is rotatably disposed on a corresponding reel holder 11.

In conjunction with FIGS. 1 and 4, in some embodiments of the disclosure, the reel holder 11 may include two opposing support plates 11.1 and a connection plate 11.2, and the same sides of the two support plates 11.1 may be connected by the connection plate 11.2, so that the reel holder 11 has a U-shape in its entirety. The reel 10 may be rotatably disposed on the two support plates 11.1, and the connection plate 11.2 may be connected to the upper vehicle frame by bolts so as to achieve the assembly of the reel holder 11 on the upper vehicle frame 1.

As shown in FIG. 4, in some embodiments of the disclosure, a plurality of reinforcing plates 11.3 may also be provided on the connection plate 11.2, and the plurality of reinforcing plates 11.3 may be parallelly disposed between the two support plates 11.1. Each reinforcing plate 11.3 can have a slot of a semi-arc shape, and a connection cylinder 11.4 may be fixedly disposed in the slots of the plurality of reinforcing plates 11.3. The two ends of the connection cylinder 11.4 in an axial direction can be fixedly connected to the two support plates 11.1, and the connection cylinder 11.4 may have a semi-circular shape. The reel 10 may be rotatably disposed in the connection cylinder 11.4, and the connection cylinder 11.4 and the plurality of reinforcing plates 11.3 can reinforce the strength of the reel holder 11. The semi-circular connection cylinder 11.4 will not interfere with the installation of the reel.

In some embodiments of the disclosure, two support plates 11.1 and one connection plate 11.2 constituting the reel holder 11 may be integrally formed to improve the strength of the reel holder 11.

In conjunction with FIG. 1 and FIG. 3, in some embodiments of the disclosure, a brake member may also be provided on the lifting motor 5, and the brake member and the reel 10 can be provided correspondingly in one-to-one relation. An output end of the brake member operably acts on the reel 10. When the lifting motor 5 stops working, the output end of the brake member 6 can act on the reel 10 to prevent the reel 10 from operating again due to the factors such as the gravity of the container, thus improving safety.

In some embodiments of the disclosure, the brake member may also be disposed on the upper vehicle frame 1. The brake member may be a brake motor. In some embodiments of the disclosure, the brake member may be selected from other types of braking devices, and the disclosure does not limit this.

In some embodiments of the disclosure, the reel holder 11 may be connected to a side of the first longitudinal beam 1.1, and the two movable pulleys 7 of each lifting assembly a can be rotatably disposed on a side of the second longitudinal beam 2.1 through a corresponding bracket 8.

In some embodiments of the disclosure, the lifting vehicle frame may further include a locking device b. The locking device b may be disposed on the lower vehicle frame 2. When the lower vehicle frame 2 and the upper vehicle frame 1 are close to each other, the lower vehicle frame 2 and the upper vehicle frame 1 can be locked with each other by operating the locking device b.

Figure 5:
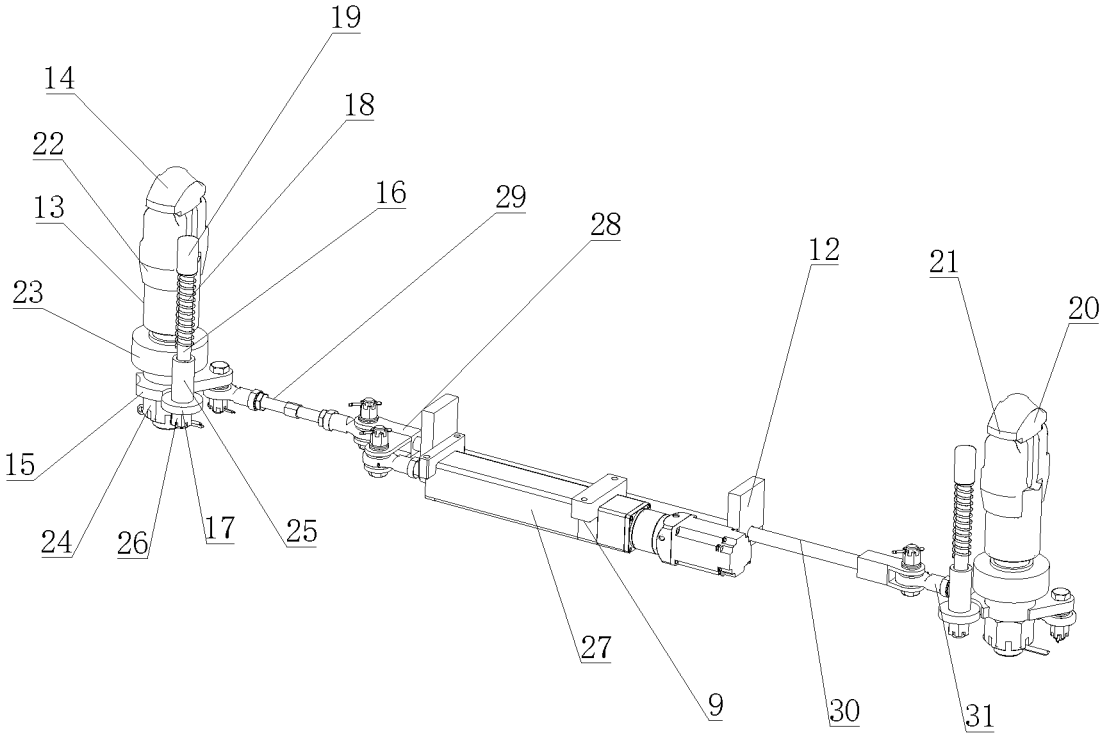
FIG. 5 is a schematic structural diagram of a locking device in FIG. 1.

FIG. 5 is a schematic structural diagram of a locking device of FIG. 1. In conjunction with FIGS. 1 and 5, in some embodiments of the disclosure, the locking device b can primarily comprise a rotary pin assembly, a fixed pin assembly, and a driving assembly.

In conjunction with FIGS. 1 and 5, in some embodiments of the disclosure, the rotary pin assembly may include a rotary pin 13, a locking head 14, and a rotary handle 15. The top of the lower vehicle frame 2 and the bottom of the lower vehicle frame 2 may be formed with first through holes 32 corresponding to the rotary pin 13, and the rotary pin 13 can fixedly pass through the first through holes at the top of the lower vehicle frame 2 and the bottom of the lower vehicle frame 2 corresponding to it. The locking head 14 may be fixedly provided on the head of the rotary pin 13, and the locking head 14 is rotatable within a corresponding lock hole. The lock hole may be disposed at the bottom of the upper vehicle frame 1. The rotary handle 15 may be fixedly provided at the bottom of the rotary pin 13, and the rotary handle 15 may be provided with a first limit face and a second limit face spaced part from each other on its periphery. The rotary handle 15 may be located below the bottom of the lower vehicle frame 2.

In conjunction with FIG. 1 and FIG. 5, in some embodiments of the disclosure, the rotary pin assembly may include a lifting pin 16, a limit block 17, and a reset spring 18. A central axis of the lifting pin 16 and a central axis of the rotary pin 13 can be parallel with each other. The top of the lower vehicle frame 2 and the bottom of the lower vehicle frame 2 may both be formed with second through holes corresponding to the lifting pin 16. The lifting pin 16 can be extendable and retractable in the second through holes at the top of the lower vehicle frame 2 and the bottom of the lower vehicle frame 2; that is, the lifting pin 16 can be operably lifted and lowered along the central axis of the lifting pin 16. The lifting pin 16 may have a support protrusion 19 thereon, and the limit block 17 may be fixedly disposed at the bottom of the lifting pin 16, and the limit block 17 may be located below the bottom of the lower vehicle frame 2. The limit block 17 can operably engage the first limit face or a second limit face to lock the rotary handle 15. The reset spring 18 can be fitted on the lifting pin 16, and the reset spring 18 may be disposed between the support projection 19 and the limit block 17. In some embodiments of the disclosure, in particular in the lower vehicle frame, the reset spring 18 can be disposed between the support projection 19 and the bottom of the lower vehicle frame 2; that is, the upper end of the reset spring 18 can be connected to the support projection 19, and the lower end of the reset spring 18 can be disposed on the bottom of the lower vehicle frame.

In some embodiments of the disclosure, the driving assembly may primarily comprise a driving mechanism. An output of the driving mechanism can be connected to the rotary handle 15, and the rotary handle 15 can be driven to rotate by operating the driving mechanism.

In some embodiments of the disclosure, when the upper vehicle frame 1 and the lower vehicle frame 2 are needed to be locked, the lower vehicle frame 2 can be controlled to rise by the lifting assembly a, so that the locking head 14 of the rotary pin 13 on the lower vehicle frame 2 can pass through a corresponding lock hole on the upper vehicle frame 1; at this time, the lifting pin 16 is pressed by the upper vehicle frame 1, and the limit block 17 is pressed synchronously, so that the rotary handle 15 on the lower vehicle frame 2 is unlocked. At this time, the reset spring 18 is in a compressed state. The driving mechanism is operated to drive the rotary handle 15 to rotate a certain angle. In turn, the locking head 14 also rotates a certain angle, so that the locking head 14 cannot drop off from the lock hole of the upper vehicle frame 1. Then the lower vehicle frame 2 is controlled by the lifting assembly a to be lowered by a small height, and the reset spring 18 is reset, thereby driving the lifting pin 16 and the limit block 17 to be reset. At this time, the limit block 17 may engage the rotary handle 15 so that the rotary handle 15 is mechanically caught by the limit block 17, and the upper vehicle frame 1 and the lower vehicle frame 2 are firmly locked. Only contrary operations are needed to separate the upper vehicle frame 1 from the lower vehicle frame 2.

As shown in FIG. 5, in some embodiments of the disclosure, the locking head 14 may be provided with two cutting faces 20 opposite to each other on its periphery, and the locking head 14 may be provided with two limit projections 21 opposite to each other on its periphery. The limit projection 21 may be located between the two cutting faces 20. A distance between the two cutting faces 20 may be less than the width of the lock hole, and a distance between the two limit projections 21 may be larger than the width of the lock hole and smaller than the length of the lock hole. When the rotary pin 13 is in an unlocked state, the locking head 14 can movably extend or retract in the lock hole. When the rotary pin 13 is in a locked state, the two limit projections 21 may be hung on a first cover plate and cannot movably extend or retract in the lock hole so as to ensure a reliable locking.

As shown in FIG. 5, in some embodiments of the disclosure, a locking seat 22 and a carrying table 23 may also be provided separately on the rotary pin 13, and the locking seat 22 and the carrying table 23 may be sequentially disposed between the locking head 14 and the rotary handle 15. The locking head 14 and the locking seat 22 may have a first gap therebetween, and the top of the lower vehicle frame 2 can be clamped in the first gap. The carrying table 23 and the rotary handle 15 can have a second gap therebetween, and the bottom of the lower vehicle frame 2 can be clamped in the second gap.

In some embodiments of the disclosure, the locking seat 22 and the carrying table 23 have spherical fit therebetween, that is, the rotary pin 13 is divided into two portions. A first portion is above the locking seat 22 and the carrying table 23 is the second portion. The first portion can have a first gap between the locking head 14 and the locking seat 22, and the first portion can be connected with the top of the lower vehicle frame 2. The second portion can have a second gap between the carrying table 23 and the rotary handle 15, and the second portion can be connected with the bottom of the lower vehicle frame 2. At the same time, the locking seat 22 and the carrying table 23 can have spherical fit therebetween, that is, the first portion and the second portion can have spherical fit, so that the first portion can float relative to the second portion to adapt to the impact generated when the upper vehicle frame and the lower vehicle frame are locked, which has good practicability.

In some embodiments of the disclosure, the bottom of the locking seat 22 may have a spherical concave surface, and the top of the carrying table 23 may have a spherical convex surface. In other embodiments of the disclosure, the bottom of the locking seat 22 may have a spherical convex surface, and the top of the carrying table 23 may have a spherical concave surface. This is not limited in the disclosure.

In some embodiments of the disclosure, the first through hole on the top of the lower vehicle frame 2 for passing the rotary pin 13 may be a waist shape hole to enable the first portion to have a conical swing in the first through hole.

As shown in FIG. 5, in some embodiments of the disclosure, the rotary pin 13 may also be provided with a first positioning block 24, and the first positioning block 24 may be fixedly disposed at the bottom of the rotary pin 13. The first positioning block 24 may be disposed against the rotary handle 15, so that the rotary handle 15 can be locked to ensure a reliable connection of the rotary handle 15.

In some embodiments of the disclosure, the first positioning block 24 may take the form of a transverse bolt or cotter pin, etc. The disclosure is not limited to this.

In some embodiments of the disclosure, the first limit face and the second limit spaced apart from each other on the periphery of the rotary handle 15 may be in the form of a groove. When the limit block 17 is located in the groove, the rotary handle 17 can be restricted from rotation.

In some embodiments of the disclosure, the bottom of the upper vehicle frame 1 may also be formed with a third through hole for passing the head of the lifting pin and thus guiding the movement of the lifting pin 16.

In conjunction with FIGS. 1 and 5, in some embodiments of the disclosure, a lifting pin assembly may also comprise a sleeve 25, and the sleeve 25 may be fixedly provided at the bottom of the partition 17. The lifting pin 16 may be extended and retracted in the sleeve 25, and the limit block 17 may be located below the sleeve 25. When the reset spring is reset, the limit block 17 may rest against the bottom of the sleeve 25; that is: the sleeve 25 has a limiting effect to keep the limit block 17 at a predetermined locking position, so as to ensure a reliable locking.

As shown in FIG. 5, in some embodiments of the disclosure, the lifting pin 16 may also be provided with a second positioning block 26, and the second positioning block 26 may be fixedly disposed on the bottom of the lifting pin 16. The second positioning block 26 may be disposed against the limit block 17, so that the limit block 17 can be locked, so as to ensure a reliable connection of the limit block 17.

In some embodiments of the disclosure, the second positioning block 26 may take the form of a transverse bolt or cotter pin, etc., and the disclosure is not limited to this.

In some embodiments of the disclosure, the driving mechanism can drive the rotary handle 15 to rotate by an angle of 90°. In some embodiments of the disclosure, the angle may be set to other angles, which is not limited in the disclosure.

In conjunction with FIG. 5, in some embodiments of the disclosure, the driving mechanism may include a driving member 27, a first link 28 and a second link 29. An output end of the driving member 27 can make a linear reciprocating movement, and the first link 28 may be L-shaped. The output end of the driving member 27 may be rotatably connected to one end of the first link 28, and the other end of the first link 28 is rotatably connected to one end of the second link 29. The other end of the second link 29 is rotatably connected to the rotary handle 15. In this way, the rotary handle 15 can be rotated by controlling the operation of the output end of the driving member 27.

In conjunction with FIG. 5, in some embodiments of the disclosure, the driving mechanism may further comprise a third link 30 and a fourth link 31, and one end of the third link 30 can be connected at a corner of the first link 28. The other end of the third link 30 can be extended away from the second link 29, and the other end of the third link 30 is rotatably connected to one end of the fourth link 31. The fourth link 31 is rotatably connected to another rotary handle 15. In this way, only one driving member 27 is needed to rotate two rotary handles 15, and thus drive two locking devices.

In some embodiments of the disclosure, the lifting vehicle frame may further comprise two guide plates 12, which are fixedly disposed and opposite to each other, and the third link 30 can movably pass through the two guide plates 12, so that the third link 30 can make a linear motion, and thus the fourth link 31 and second link 22 can be miniaturized to optimize the configuration of the lower vehicle frame.

In some embodiments of the disclosure, the guide plate 12 may be fixed between the top and the bottom of the lower vehicle frame 2, and the driving member 27 may also be fixed on a fixed base 9, and the fixed base 9 may be fixedly disposed between the top and the bottom of the lower vehicle frame 2.

In some embodiments of the disclosure, the driving member can use a servo linear actuator, or other mechanism, such as a hydraulic cylinder, the disclosure is not limited to this.

In some embodiments of the disclosure, the lower vehicle frame 2 may also be provided with a position sensor 22 corresponding to the limit block 17 in one to one relation. When the limit block 17 is lowered to a pre-set position, it can be controlled by a position sensor corresponding to it, and thus the limit block 17 can control the driving member to start work, thereby realizing automatic operation.

In some embodiments of the disclosure, each third cross beam 2.2 and each fourth cross beam 2.3 may be provided with a locking device therein, and the driving member of the locking device can extend and retract in a transverse direction.

In some embodiments of the disclosure, the lower vehicle frame and the container can be assembled and connected by a locking assembly. The locking assembly is the same as that used when a container is connected to an aerial vehicle by jacking equipment in the prior art, which is not limited in the disclosure.

As shown in FIG. 1, in some embodiments of the disclosure, a container anti-falling device 3 may be provided at both ends of the third cross beam 4.3. After the lower vehicle frame and the container are assembled, the container anti-falling device will hold the container, so as to improve the safety during container transportation.

In some embodiments of the disclosure, the specific structure of the container anti-falling device may be the same as that disclosed in the Chinese Application No. "201811638159.0", entitled "Container anti-falling Device", which will not be described in the disclosure.

In some embodiments of the disclosure, the aerial rail container transportation method may be implemented by the aerial transportation vehicle described in this disclosure. The aerial transportation vehicle includes a lifting vehicle frame, which includes an upper vehicle frame, a lower vehicle frame, a lifting assembly, and a locking device. The lower vehicle frame and the upper vehicle frame can move close to or away from each other by operating the lifting assembly. The lower vehicle frame and the upper vehicle frame close to each other can be locked together by operating the locking device. The method includes: the aerial transportation vehicle free of load running into position and stopping so that the container is located directly below the aerial transportation vehicle; operating the lifting assembly to separate the upper vehicle frame and the lower vehicle frame, and lower the lower vehicle frame to a preset height; completing the locking of the lower vehicle frame and the container; operating the lifting assembly, so that the lower vehicle frame and the container rise as a whole; operating the locking device to lock the upper vehicle frame and the lower vehicle frame together; and the aerial transportation vehicle being started for transportation after the container assembly process is completed.

In some embodiments of the disclosure, the specific steps of lifting a container by the aerial transportation vehicle provided by the disclosure may comprise:

the non-loaded aerial transportation vehicle free of load running into position and stopping, at which time the container is located directly below the vehicle→operating the lifting assembly so that the upper vehicle frame and the lower vehicle frame are separated→operating the lifting assembly, so that the lower vehicle frame is lowered down→opening the container anti-falling device on the lower vehicle frame→operating the locking device between the lower vehicle frame and the container to complete the locking of the lower vehicle frame and the container→operating the lifting assembly so that the lower vehicle frame and the container rise as a whole→the container anti-falling device on the lower container being shrunk to hold the container→operating the lifting assembly and the locking device, so that the upper vehicle frame and the lower vehicle frame are locked→the aerial transportation vehicle being started for transportation after the assembly of the container is completed. For the unloading process, contrary operations will be done.

In summary, the aerial transportation vehicle provided by the disclosure can achieve assembly and connection of the aerial transportation vehicle with the container through its own devices, which is simple in operation, and has high automation level and good practicability.

The embodiments described above are preferred embodiments of the disclosure, which are only used to facilitate the description of the disclosure rather than limiting the disclosure in any form. Any equivalent embodiments obtained by those of ordinary skill in the art by partially modifying or changing the embodiments of the disclosure based on the content of the disclosure without departing from the technical features of the disclosure all fall within the scope of the disclosure.

The invention claimed is:

1. A lifting vehicle frame, comprising:

an upper vehicle frame;

a lower vehicle frame;

a lifting assembly, the upper vehicle frame and the lower vehicle frame being connected through the lifting assembly, at least two lifting assemblies being provided in a first direction; the lower vehicle frame and the upper vehicle frame being able to move close to or away from each other by operating the at least two lifting assemblies, and each lifting assembly including a lifting motor, a wire rope, and a movable pulley, wherein, two lifting motors are provided opposite to each other in a second direction, and the two lifting motors are fixed to the upper vehicle frame; the second direction and the first direction are perpendicular to each other;

the movable pulley and the lifting motor are provided correspondingly in one-to-one relation, and two movable pulleys are rotatably disposed on the lower vehicle frame in the second direction; and the wire rope, the lifting motor and the movable pulley are provided correspondingly in one-to-one relation, and the wire rope has a first end and a second end opposite to each other; the first end and the second end of the wire rope both are wound on an output end of a corresponding lifting motor, and the movable pulley is disposed in the middle of a corresponding wire rope; and a locking device, the locking device is disposed on the lower vehicle frame; the lower vehicle frame and the upper vehicle frame are locked with each other by operating the locking device when the lower vehicle frame and the upper vehicle frame are close to each other, wherein each lifting assembly is provided with a corresponding lifting motor fixedly provided with a reel.

2. The lifting vehicle frame according to claim 1, the first end and second end of the wire rope are wound on the reel of the corresponding lifting motor.

3. The lifting vehicle frame according to claim 2, wherein a brake member is provided on the lifting motor;

the brake member and the reel are provided correspondingly in one-to-one relation, and an output end of the brake member operably acts on the reel.

4. The lifting vehicle frame according to claim 1, wherein the locking device comprises:

a rotary pin;

a locking head, fixedly disposed at a head of the rotary pin;

a rotary handle fixedly disposed at a bottom of the rotary pin, the rotary handle is formed with a first limit face and a second limit face on its periphery;

a lifting pin, a central axis of the lifting pin and a central axis of the rotary pin are parallel with each other; the lifting pin operably moves up and down along the central axis of the lifting pin, and the lifting pin is provided with a support protrusion;

a limit block, the limit block is fixedly disposed at a bottom of the lifting pin, and the limit block is operably engaged with the first limit face or the second limit face;

a reset spring, the reset spring is fitted on the lifting pin, and the reset spring is disposed between the support protrusion and the limit block;

a driving mechanism, an output end of the driving mechanism is connected to the rotary handle, and the rotary handle is rotated by operating the driving mechanism; and wherein the upper vehicle frame is formed with a lock hole corresponding to the locking device at its bottom, and the locking head of the locking device is rotatable within a corresponding lock hole;

a top and bottom of the lower vehicle frame both are formed with a first through hole corresponding to the rotary pin of the locking device;

the rotary pin fixedly passes through corresponding first through holes at the top and bottom of the lower vehicle frame, and the rotary handle is located below a bottom of the lower vehicle frame;

the top and bottom of the lower vehicle frame both are formed with a second through hole corresponding to the lifting pin of the locking device, and the lifting pin is extendable and retractable inside the second through holes at the top and bottom of the lower vehicle frame; and the reset spring is disposed between a support projection and a partition.

5. The lifting vehicle frame according to claim 4, wherein the rotary pin is provided with a locking seat and a carrying table spaced apart from each other, and the locking seat and the carrying table are sequentially disposed between the locking head and the rotary handle;

a first gap is formed between the locking head and the locking seat, and a top of the lower vehicle frame is clamped in the first gap; and a second gap is formed between the carrying table and the rotary handle, and the bottom of the lower vehicle frame is clamped in the second gap.

6. The lifting vehicle frame according to claim 5, wherein the locking seat and the carrying table fit with each other with spherical surfaces.

7. The lifting vehicle frame according to claim 4, wherein a bottom of the upper vehicle frame is formed with a third through hole fitted with the locking device, and the third through hole is passed by a head portion of the lifting pin of a corresponding locking device.

8. The lifting vehicle frame according to claim 4, wherein the locking device further includes a sleeve, the sleeve is fixedly disposed below a bottom of the lower vehicle frame;

the lifting pin is extendable and retractable in the sleeve, and the limit block is located below the sleeve.

9. An aerial transportation vehicle including the lifting vehicle frame of claim 1.

10. An aerial rail container transportation method implemented by using the aerial transportation vehicle of claim 9, and wherein the aerial transportation vehicle includes the lifting vehicle frame, and the lifting vehicle frame includes the upper vehicle frame, the lower vehicle frame, the lifting assembly and the locking device; the lower vehicle frame and the upper vehicle frame is able to move close to or away from each other by operating the lifting assembly; the lower vehicle frame and the upper vehicle frame close to each other is able to be locked with each other by operating the locking device;

and the method comprises:

the aerial transportation vehicle being free of load and running into position and stopping, so that a container is located directly below the aerial transportation vehicle;

operating the lifting assembly to separate the upper vehicle frame from the lower vehicle frame;

operating the lifting assembly to lower the lower vehicle frame;

opening a container anti-falling device on the lower vehicle frame;

completing a locking of the lower vehicle frame and the container by operating the locking device therebetween;

operating the lifting assembly, so that the lower vehicle frame and the container rise as a whole;

the container anti-falling device on the lower vehicle frame being shrunk so that the container anti-falling device holds the container;

operating the lifting assembly and the locking device so that the lower vehicle frame and the upper vehicle frame are locked with each other; and the aerial transportation vehicle being started for transportation after a container assembly process is completed.

* * * * *